US005403011A

United States Patent [19]

Schwartz

[11] Patent Number: 5,403,011

[45] Date of Patent: Apr. 4, 1995

[54] UNIFORMLY CONSTRUCTED GAME BOARD WITH STYLE AND COLOR CODING, METHODS OF CONSTRUCTING SAME, AND RELATED GAMES

[76] Inventor: Franklin B. Schwartz, P.O. Box 100309, Brooklyn, N.Y. 11210

[21] Appl. No.: 121,516

[22] Filed: Sep. 16, 1993

[51] Int. Cl.[6] ..... A63F 3/00

[52] U.S. Cl. ..... 273/243; 273/261; 273/274

[58] Field of Search ..... 273/264, 271, 248, 255, 273/260, 261, 242, 236

[56] References Cited

U.S. PATENT DOCUMENTS

| | | | |
|---|---|---|---|
| D. 146,060 | 12/1946 | Muncheryan | 273/242 |
| D. 225,539 | 12/1972 | Guthrie | 273/242 |
| 2,239,449 | 4/1941 | Senz | 273/264 |
| 3,658,337 | 4/1972 | Peters et al. | 273/254 |
| 4,005,868 | 2/1977 | Hein | 273/156 |
| 4,173,347 | 11/1979 | Field | 273/261 |
| 4,288,078 | 9/1981 | Lugo | 273/264 |
| 4,391,449 | 7/1983 | Johnson | 273/260 |

FOREIGN PATENT DOCUMENTS

| | | | |
|---|---|---|---|
| 798746 | 11/1968 | Canada | 273/261 |

*Primary Examiner*—Benjamin H. Layno

[57] ABSTRACT

A game board for the playing of board games with a set or sets of areas on it which have unusual characteristics of uniformity such that each area is adjacent, either by a border or a bridge, to exactly the same number of areas in its set as every other area in its set and games which utilize said game board and said method of applying style and color coding schemes.

9 Claims, 16 Drawing Sheets

UNIFORMLY CONSTRUCTED GAME BOARD WITH STYLE AND COLOR CODING, METHODS OF CONSTRUCTING SAME, AND RELATED GAMES

BACKGROUND OF THE INVENTION

1. Field of the Invention

The invention relates to a game board, usually provided with a set of playing pieces for the purpose of playing a game in which the relationship between the areas on the board is relevant to the game's characteristics.

2. Prior Art

Many such games are already in existence, some of them being popular solely for purposes of entertainment (such as backgammon), some being educational as well (such as chess or reversi). Though the boards presented in this invention are useful for games of both categories, this invention widely expands the set of possibilities for other such games, and presents two other such games as examples.

Probably the closest prior art to the uniformity aspect of this invention is U.S. Pat. No. 4,005,868, titled "Puzzle" (in which the claims, stating that each board would have a number of points between areas corresponding to the number of vertices on a polyhedron whose faces the areas represent, contradicted the illustrations, all of which had more points than the number of vertices on its represented polyhedron, unless the entire circles containing the outer points were to be considered to be single points, which circles containing a plurality of points are not and should therefore not be considered to be), which although it presents an uncountably infinite variety of boards which can be viewed as having a quality of uniformity (to be described in further detail hereinafter; the "Puzzle" inventor did not in fact define his boards with this view of them in mind, as in order to obtain this view, one must consider the lines which he described as lines from areas to vertices to be themselves borders of areas) similar to the uniformity that is one aspect of this invention (for which reason the uniformity in this invention was defined to exclude those defined by the "Puzzle" patent), presents only an infinitesmal (though perhaps countably infinitesmal) fraction of the uncountably infinite variety of boards having this quality. The invention described herein presents an uncountably infinite variety of configurations which is at least infinitely greater (if not uncountably infinitely greater) than the variety of boards of the "Puzzle" invention, having a similar, though not equivalent, quality (In some cases the uniformity is more pure; in other cases it is less). Also, the "Puzzle" includes boards which do not have this uniformity at all (the "Puzzle" inventor only gave examples of mappings for regular polyhedrons, but did not limit his claims to mappings of regular polyhedrons, and only a mapping for a regular polyhedron would have this uniformity).

SUMMARY OF THE INVENTION

The new gameboard introduced by this invention is a game board on which there is at least one set (this set shall be referred to hereinafter as the qualifying set) of at least 6 areas (an area is defined hereinafter as a distinctly outlined area, distinctly outlined meaning that the area's is either totally physically visible or, as in the case of a dotted outline or a solidly filled area with a border and bridge of the same color, can be totally visualized from the portion of the area's outline which is physically visible; a set of areas is defined hereinafter as one or more such areas taken as a group;

an adjacency to a second area is defined hereinafter as one or more bridges and/or borders between the area having the adjacency and the second area; a bridge adjacency is defined hereinafter as any adjacency which consists of one or more bridges, and optionally one or more borders, between two areas; a border adjacency is defined hereinafter as any adjacency consisting of one or more borders, and optionally one or more bridges, between two areas; an internal adjacency is defined hereinafter as a connection via one or more bridges and/or borders from the area having the adjacency to another area in the same set as the area having the adjacency; an external adjacency is defined hereinafter as a connection via one or more bridges and/or borders from the area having the adjacency to an area not in the set of the area having the adjacency; a bridge is defined hereinafter as any line from one area to another with the limitation that no bridge is angled at an intersection without being in some way obviously distinguishable from any other bridge or bridges that angle at the same intersection, and that, although a border between 2 areas may be considered a bridge between two other areas, a bridge may not have any bridge intersecting it from only one side, nor may a bridge have any point at which a border intersects from one side and no border intersects from the other. For example, in FIG. 1, which contains a qualifying set whose areas bear indicia numbered from 1 to 7, area 6 is adjacent via bridges to areas 1, 2, 4, and 7. The bridge from area 6 to area 1 intersects the bridge from area 3 to area 4, forming an angled line from area 3 to area 6, but area 6 is not adjacent to area 3 via this angled line as this angled line is angled at an intersection. However, if this angled line were red, while the complementary angled line formed at this intersection remained black, both the red angled line and the black angled line at this intersection would be considered bridges. The line on the edge of the board design from area 6 to area 5, which does not angle at an intersection is also not a valid adjacency, because two of the borders of area 7 intersect it from one side at points where there is no intersection from the other side; a border is defined hereinafter as a line which is the border between two and only two areas. Also note that for the purposes of this invention, a single point is not considered an adjacency, although in Euclidean geometry, a point can be considered a line of zero length. Finally, note that a border which has no color of it's own cannot be considered as a bridge; for example the border between a black square and a white square on a traditional chessboard cannot be considered a bridge) such that all of the following statements hold true:

(1) Each area in the qualifying set has the same number n of internal specifiable adjacencies (specifiability is not a characteristic of the adjacencies themselves; "specifiable adjacencies" simply means that in order to fill the requirements of a qualifying set, the adjacencies within a set of areas must be specifiable as border, bridge or either, or otherwise specifiable as being members of some other distinct classification, such as having the same color, linestyle, etc.; e.g. with regard to bridges vs. borders vs. either, in FIG. 1, the specifiable adjacencies are bridge adjacencies. Therefore, if a bridge adjacency were added between areas 3 and 6, resulting in a board having the adjacencies shown in FIG. 2, there would no longer be a qualifying set, while if a border adjacency were added to FIG. 1 between areas 3 and 6, resulting in a board having the adjacencies shown in FIG. 3, the set of areas 1 through 7 would still be a qualifying set, as the number of specifiable—in this case, bridge—adjacencies is not affected. Also, if in FIG. 1, the adjacency between areas 4 and 7 were changed to a border, resulting in a board having the adjacencies shown in FIG. 4, the set of areas 1 through 7 would still be a qualifying set, but adjacencies would be specifiable as being either bridge or border. Also, if a border adjacency were added to FIG. 4 between areas 3 and 6, resulting in a board having the adjacencies shown in FIG. 5, the set of areas 1 through 7 would no longer be a qualifying set, as adjacencies could not be specified as bridge, border, or either, and still meet this requirement—For example, if in FIG. 5, adjacencies are specified as bridge, area 7 has one internal specifiable adjacency less than area 1. If in FIG. 5, adjacencies are specified as either, area 6 has one internal specifiable adjacency more than area 1. Finally note that, for purposes of simplification, the classification of lines for all bridges and borders is assumed to be the same for FIG. 1 through FIG. 5; for example, if the added bridge in FIG. 2 was bright red, adjacencies could be specified as black bridge, and the numbered areas would then be a qualifying set), where n is a number greater than 2 (any set of three or more areas meeting the condition that each area within it has the same number of internal specifiable adjacencies, whether or not it is a qualifying set, shall be referred to hereinafter as a uniform adjacency set). FIG. 1 shows a qualifying set with numbered areas which contains only bridge adjacencies (since this set contains more than 6 areas, FIG. 1 could be the complete design of a board embodying this invention, as could FIG. 3 and FIG. 4); FIG. 6 shows a board made up of two qualifying sets: a qualifying set of 20 black areas with specifiable bridge adjacencies, and a qualifying set of 12 white areas with specifiable border adjacencies (since both of these qualifying sets have more than six areas, either one could alone be the complete design of a board embodying this invention, and FIG. 6 could be the complete design of a board embodying this invention). In addition to the internal adjacencies of the board design in FIG. 6, each area has external border adjacencies to areas in the other set.

(2) There is a path of specifiable adjacencies from any one area in the qualifying set to any other area in the qualifying set (e.g. in FIG. 6, there is a path of border adjacencies between any two white areas, and a path of bridge adjacencies between any two black areas).

(3) The qualifying set is not a mapping of a polyhedron such that: each surface of the polyhedron is represented by an space (there is no conceptual difference between an "area" and a "space", but in the context of this case, referring to certain areas as "spaces" simplifies the specification) which is not a member of the set, said spaces being mutually spaced from each other, each of all but one of the corners of the polyhedron is represented by a point, the remaining corner is represented either as a point or as a circle which is made up of the outermost borders of the outermost areas of the set, each space representing a face of the polyhedron is connected to each of the representations of its corners by a line, and no line connecting a face representation to a corner representation crosses any other line on the board. FIG. 7 shows an example of a board which contains a set of white bordered areas with numbered indicia which would be a qualifying set if not for this restriction.

(4) The qualifying set is not drawn as two concentric groupings of areas of equal size and shape such that each area is adjacent by straight radial borders to exactly two other areas in its own grouping of areas and adjacent by a border to exactly one other area in the grouping of areas which it is not a member of. FIG. 8 shows an example of a set of areas which would be a qualifying set and a legitimate complete board design if not for this restriction.

(5) The qualifying set is not drawn as area lying on outlines of two concentric geometrically similar linearly symmetric shapes such that each area is adjacent by bridges to exactly two other areas on the same such shape outline and adjacent by a straight radial bridge to exactly one other area which on the shape outline which it itself does not lie on. FIG. 9 shows an example of a set of areas which would be a qualifying set and a legitimate complete board design if not for this restriction.

(6) If the qualifying set must be specified as having bordered adjacencies in order to be a uniform adjacency set, has three adjacencies per area, is the only uniform adjacency set, and is geometically rotationally symmetrical (geometrically rotationally symmetrical meaning:

(a) the qualifying set is rotationally symmetrical, rotational symmetry being defined hereinafter as the condition that radial lines could be drawn from a point such that each area in the rotationally symmetrical set is crossed by a radial line the same number of times, and (b) under the condition that all radial lines are the same length and the same angular distance from each other in both directions, each such radial line crosses the outlines of areas of the qualifying set at intervals equal in distance to the intervals of each other such radial line), then the qualifying set contains at least seven areas.

FIG. 10 shows a rotationally symmetrical set of areas which would be a qualifying set and a legitimate complete board design if not for this restriction; FIG. 11 shows a rotationally symmetrical board design which is a qualifying set and a legitimate complete design for a board that is an embodiment of this invention.

The uniqueness of the board comes from the fact that if a playing piece is limited to movement within a uniform adjacency set, and allowed to move only via the specified adjacencies within that set, there is no area in that set which is inherently more advantageous than any other area in that set in terms of choices available. For example, in a traditional chess game, the center squares are generally considered advantageous; a queen placed on any one of the four center squares is capable of moving to any one of 27 squares (barring obstructions), whereas a queen placed on a corner square has to choose from 21. In addition, the 27 choices available from the center square contain a larger quantity of better squares (squares toward the center than the 21 choices available from the corner square); for example, three of the 27 squares available from the center square would be the other three center squares, while only two of the center squares can be reached from the corner square.

It is easy to see that the four center squares of a chess board would be a uniform adjacency set, but it is also easy to see why they do not qualify the chessboard as an embodiment of this invention (there are only four of them).

One of the preferred embodiments of this invention was originally a game similar to traditional chess played on the board shown in FIG. 6, with a qualifying set of 12 black areas adjacent by bridges superimposed on a qualifying set of 20 white areas adjacent by borders; the black areas were adjacent to the white areas by borders. A player controlling "White" pieces, and a player controlling "Black" pieces would each control 15 pieces with moving ability as follows:

(1) One "Bishop" which could follow any unobstructed path (i.e. path containing no other piece) of white adjacent areas.
(2) A "Bishop" which could follow any unobstructed path of black adjacent areas.
(3) A "Rook" which could follow any unobstructed path of alternating black and white areas.
(4) A "Queen" which could move like a "Bishop" or a "Rook".
(5) A "King" which could move to any adjacent area.
(6) 10 pawns which could move to from an area to a bridge/border or from a bridge/border to an area.

BRIEF DESCRIPTION OF THE DRAWINGS

FIG. 9 shows a design for a board which, although it contains a uniform adjacency set of areas (i.e. all of the circular black areas), is not an embodiment of this invention, as the areas of the only set which could otherwise be a qualifying set are specified as having bridge adjacencies (and must be in order to be considered a uniform adjacency set), and lie on the outlines of two concentric geometrically similar linearly symmetric shapes such that each area is adjacent by bridge to two areas lying on the same such outline as itself, and adjacent by a straight radial bridge to one area lying on the other such outline that it itself does not lie on.

DETAILED DESCRIPTION OF PREFERRED EMBODIMENTS

Figure 1:
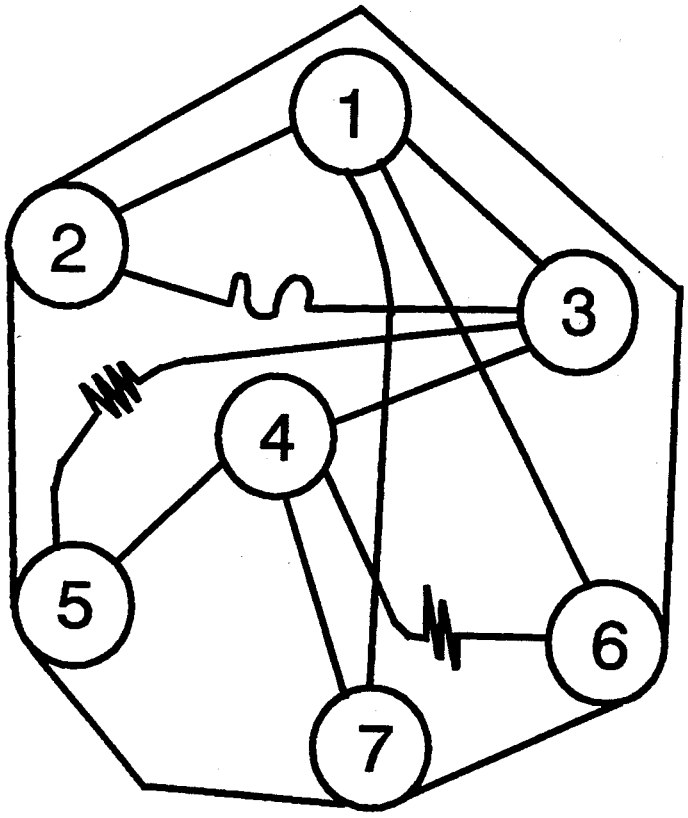
FIG. 1 shows a design for a board which is an embodiment of this invention (having a qualifying set of 7 areas, each of these seven areas having a numerical indicia) on which the 7 areas of the qualifying set can be specified as having bridge adjacencies.
Figure 2:
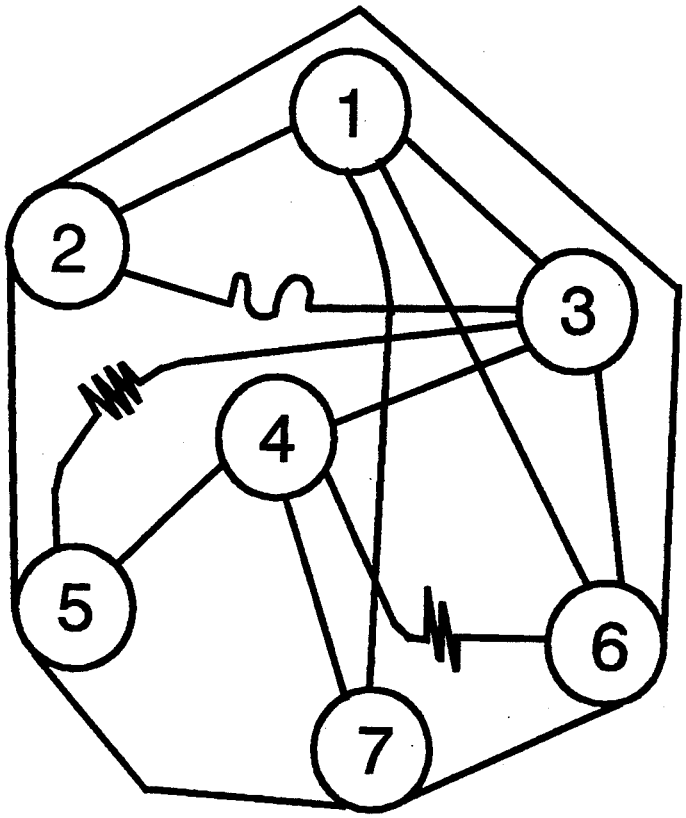
FIG. 2 shows a design for a board which is not an embodiment of this invention. Although similar to the board design shown in FIG. 1, this board contains no qualifying set of areas. The set of areas with numerical indicia (corresponding to the qualifying set of areas on the board shown in FIG. 1) is not a qualifying set because of the extra bridge between the area with the indicia "3" and the area with the indicia "6", which causes each of these two areas to have one more bridge adjacency than each other remaining area in the 7 area set.
Figure 3:
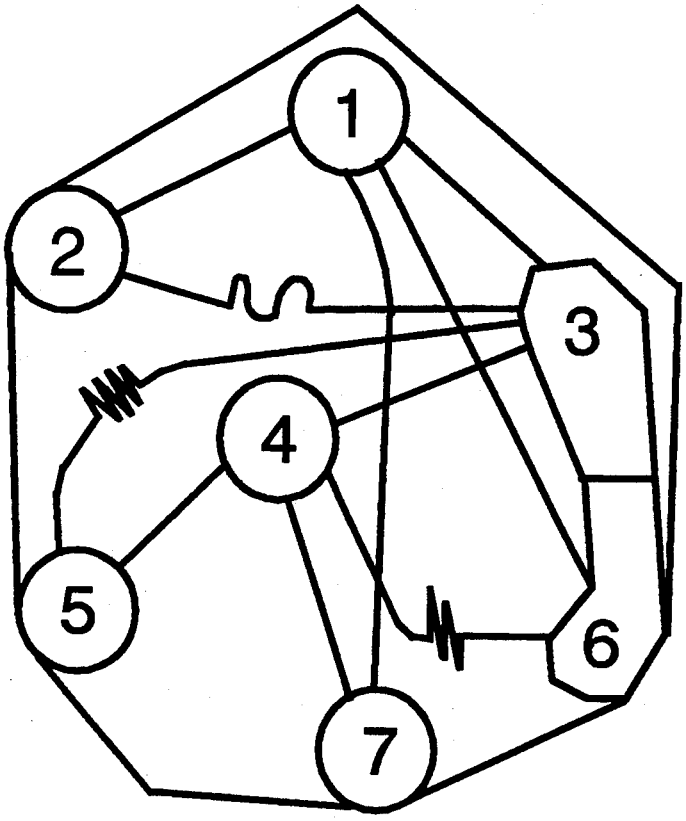
FIG. 3 shows a design for a board which is an embodiment of this invention (having a qualifying set of 7 areas, each having a numerical indicia) on which the 7 areas of the qualifying set can be specified as having bridge adjacencies. The board design is similar to the board design of FIG. 2, except that the adjacency between the area with the indicia "3" and the area with the indicia "6" is a border adjacency, which does not have any affect on the number of bridge adjacencies.
Figure 4:
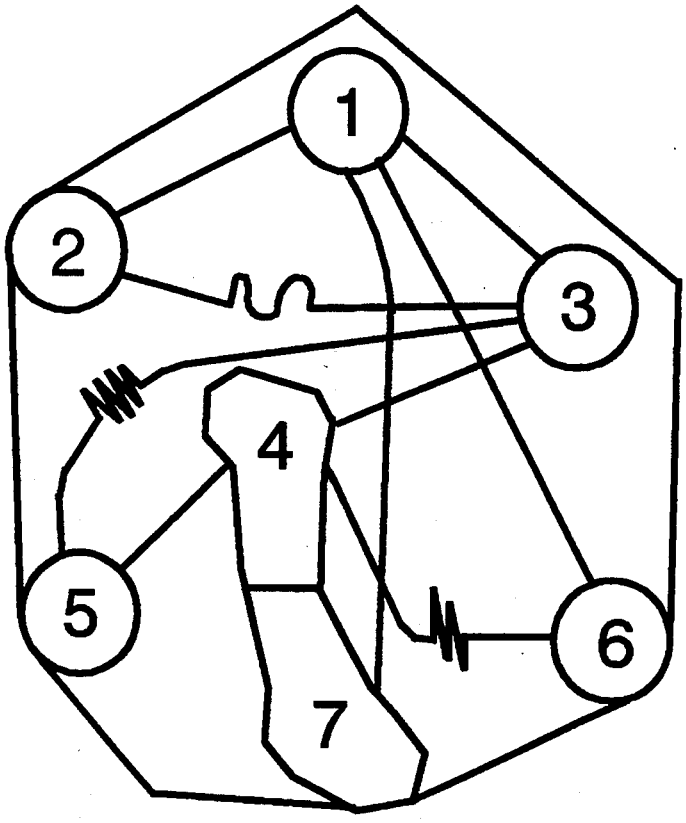
FIG. 4 shows a design for a board which is an embodiment of this invention (having a qualifying set of 7 areas, each having a numerical indicia) on which the 7 areas of the qualifying set can be specified as having adjacencies which are either bridge or border. This board design is similar to the one shown in FIG. 1, with the exception that the adjacency between the area with the indicia "4" and the area with the indicia "7" is a border adjacency.
Figure 5:
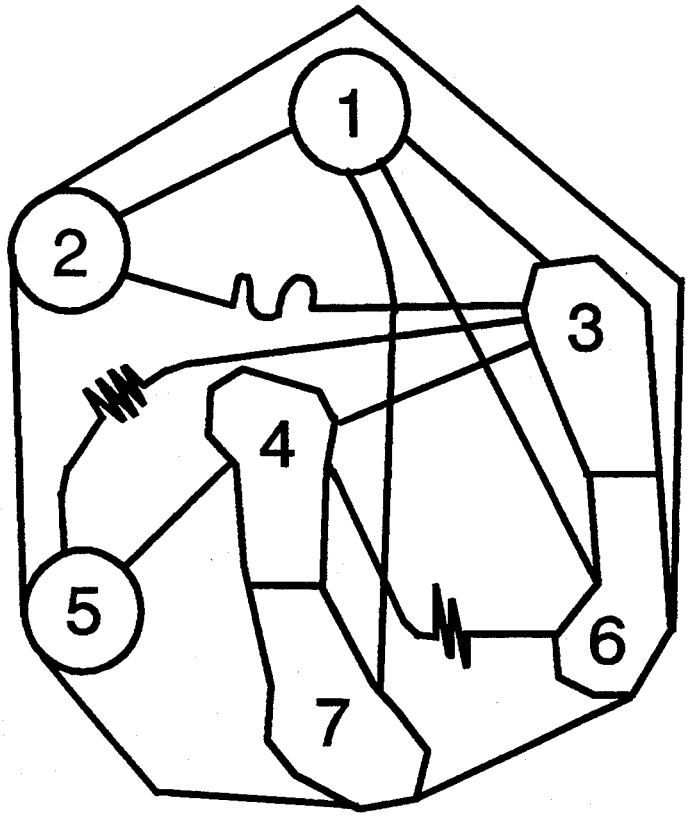
FIG. 5 shows a design for a board which is not an embodiment of this invention. Although similar to the board design shown in FIG. 3 and FIG. 4, this board design contains no qualifying set of areas. The set of 7 areas with numerical indicia (corresponding to the qualifying sets of areas in FIG. 3 and FIG. 4) is not a qualifying set because: if adjacencies in this set are specified as bridge (as in FIG. 3), the border adjacency between the area with the indicia "4" and the area with the indicia "7" causes each of these two areas to have one less specifiable (i.e. bridge) adjacency than each other remaining area in this set; if adjacencies in this set are specified as either bridge or border, as in FIG. 4, the border adjacency between the area with the indicia "3" and the indicia "6" causes each of these to have one more specifiable (i.e. bridge or border) adjacency than each other remaining area in this set.
Figure 6:
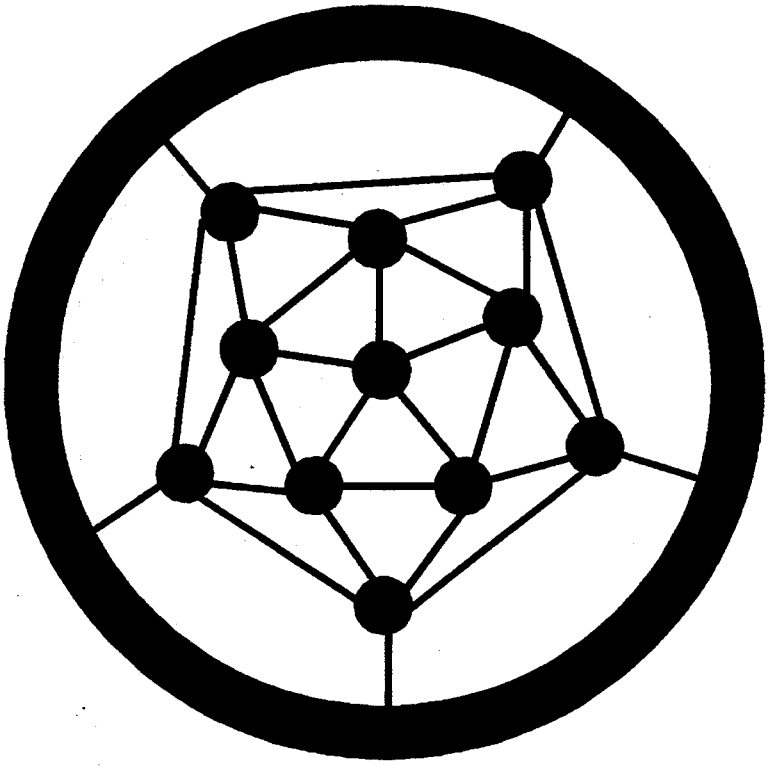
FIG. 6 shows a design for a board which is an embodiment of this invention, having two qualifying sets: a qualifying set of 12 black areas with bridge adjacencies, and a qualifying set of 20 white areas with border adjacencies. This design was the original design for the fourth preferred embodiment of the invention. In this design, each bride between two areas of the first qualifying set serves as a border between two areas of the second qualifying set.
Figure 7:
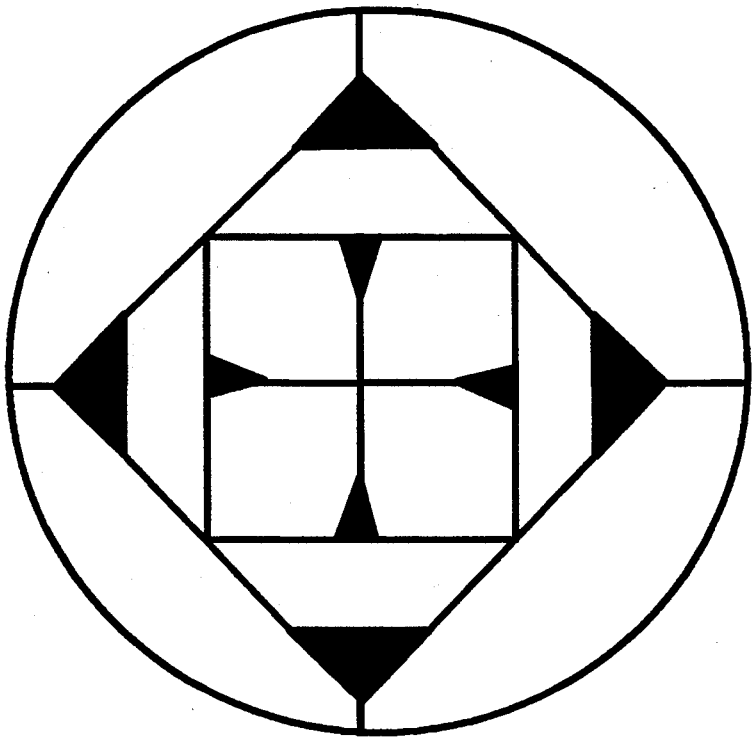
FIG. 7 shows a design for a board which, although it contains a uniform adjacency set of 12 white areas, is not an embodiment of this invention, as the uniform adjacency set is a mapping of a polyhedron (i.e. a cube) such that the faces of the polyhedron are represented by black areas which are not members of the uniform adjacency set of white areas, and each of these black areas is connected by a line to a representation of each of its four corners, each of which is either a point or the outer circle which is made up of the outermost borders of the outermost areas of the uniform adjacency set, and none of the lines from face representations to corner representations cross each other. (This board design is similar to one shown in U.S. Pat. No. 4,005,868, the "Puzzle" discussed earlier)
Figure 8:
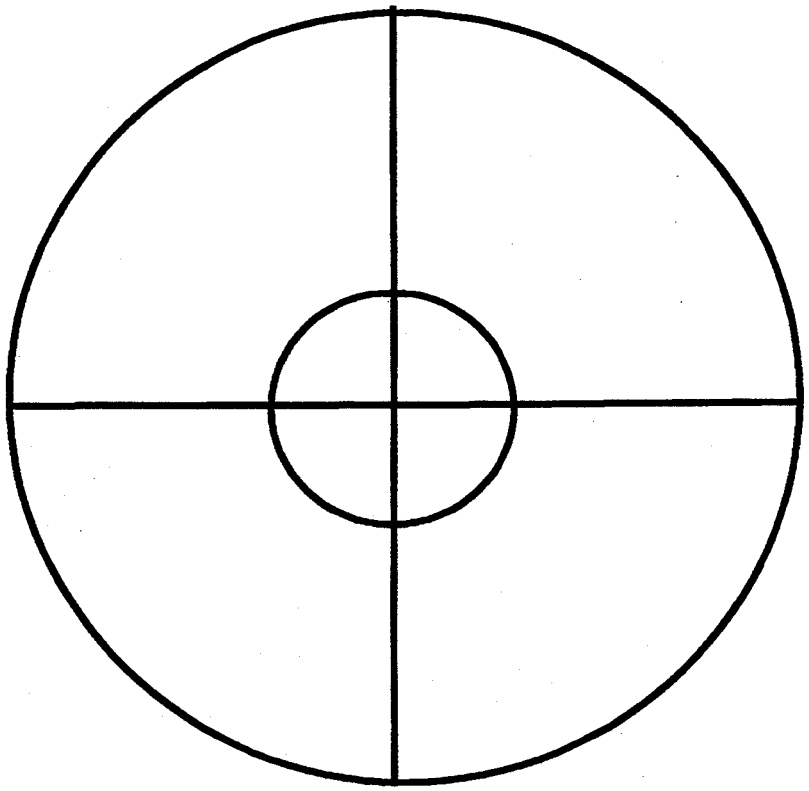
FIG. 8 shows a design for a board which, although it contains a uniform adjacency set of 8 areas (i.e. all of the bordered areas shown) is not an embodiment of this invention, as the areas of the only set which could otherwise be a qualifying set are specified as bordered (and must be in order to be considered a uniform adjacency set), and arranged as two concentric groupings of areas such that each area is adjacent by straight radial borders to two areas in its own grouping of areas and one area in the grouping of areas of which it is not a member.
Figure 9:
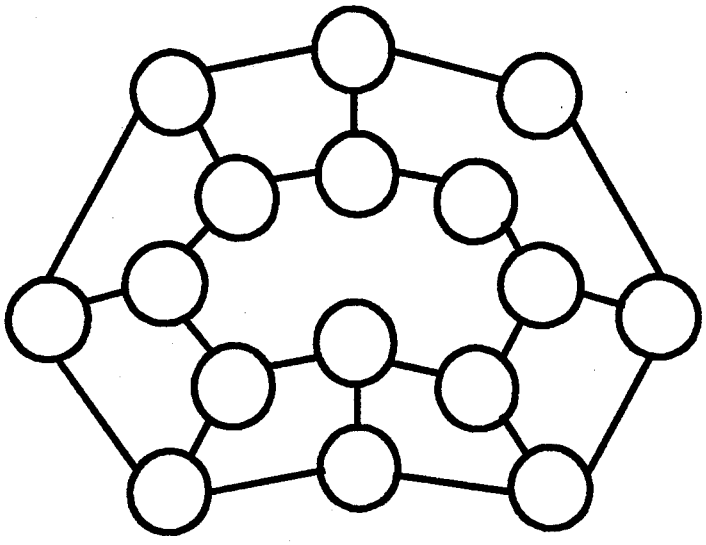
Figure 10:
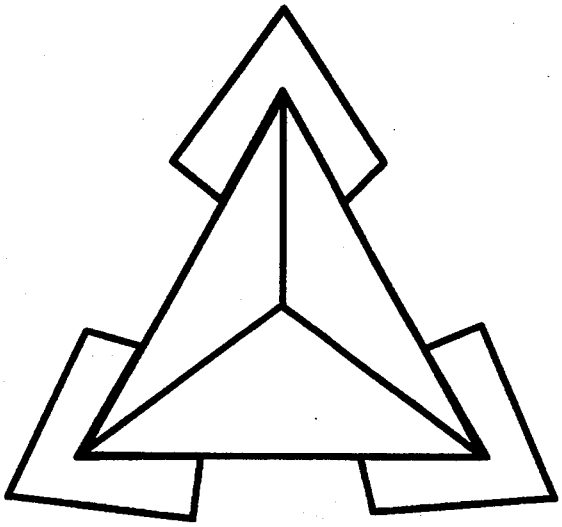
FIG. 10 shows a design for a board which, although it contains a uniform adjacency set of six areas (i.e. all of the bordered areas shown) with three adjacencies per area, is not an embodiment of this invention, as the areas of the only set which would otherwise be a qualifying set are specified as border (and must be in order to be considered a uniform adjacency set), and the uniform adjacency set is geometrically rotationally symmetrical.
Figure 11:
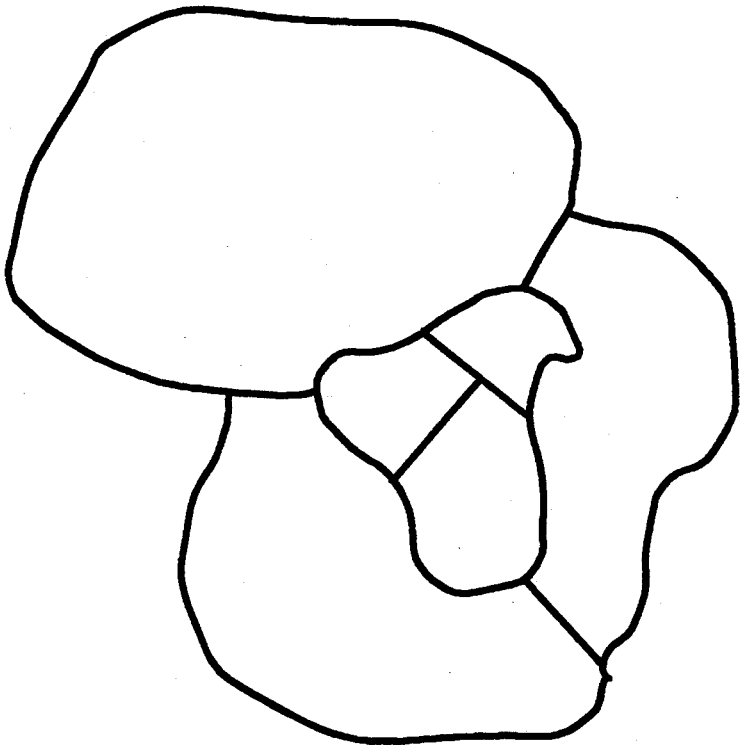
FIG. 11 shows a design for a board which is similar to the one shown in FIG. 10, but which is an embodiment of this invention. Although its only uniform adjacency set contains six areas with three adjacencies per area, must be specified as having bordered adjacencies, and is rotationally symmetrical as defined herein, it is not geometrically rotationally symmetrical.
Figure 12:
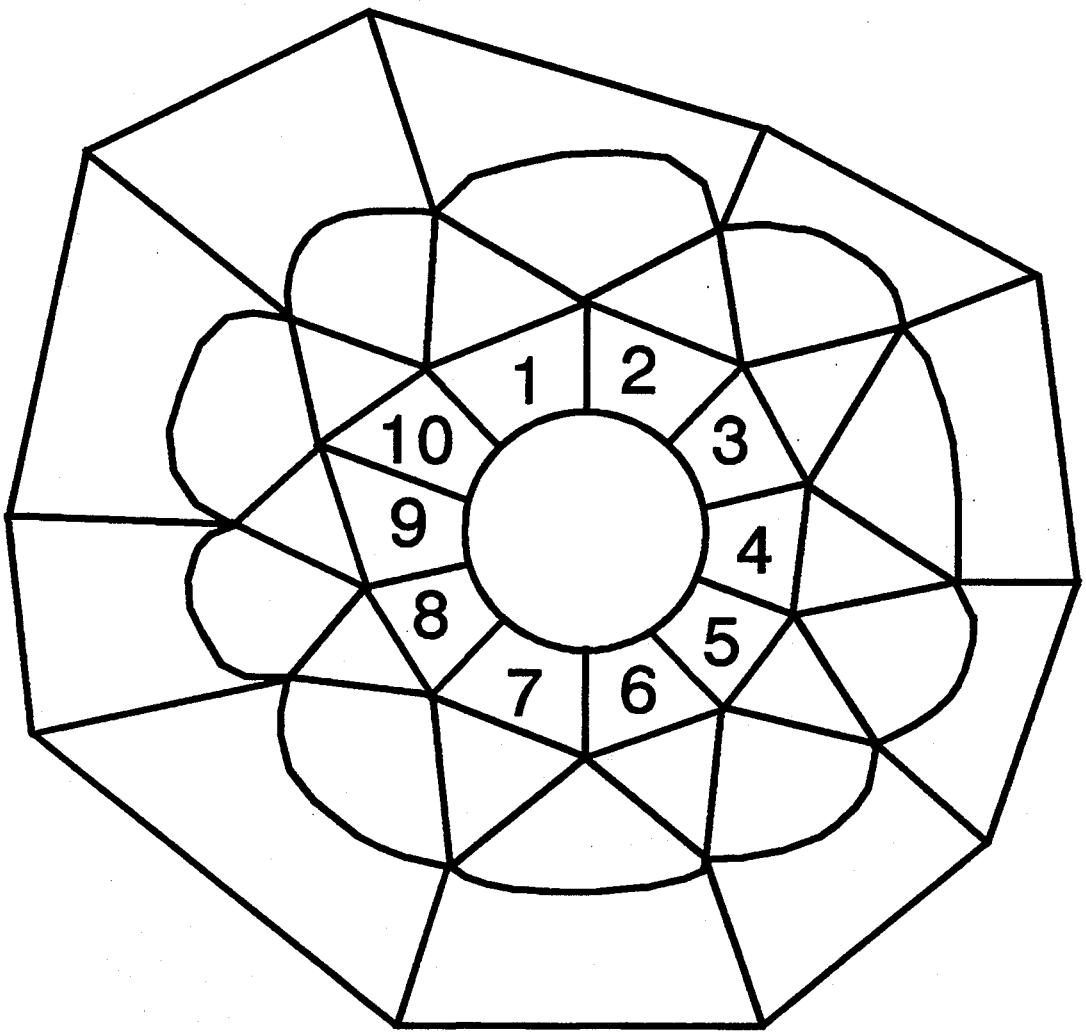
FIG. 12 shows a design for a board which is an embodiment of this invention, which has indicia and which could have a spinner placed in the center. On this board, the qualifying set is made up of all non-circular areas on the board design, and adjacencies are specifiable as border.
Figure 13:
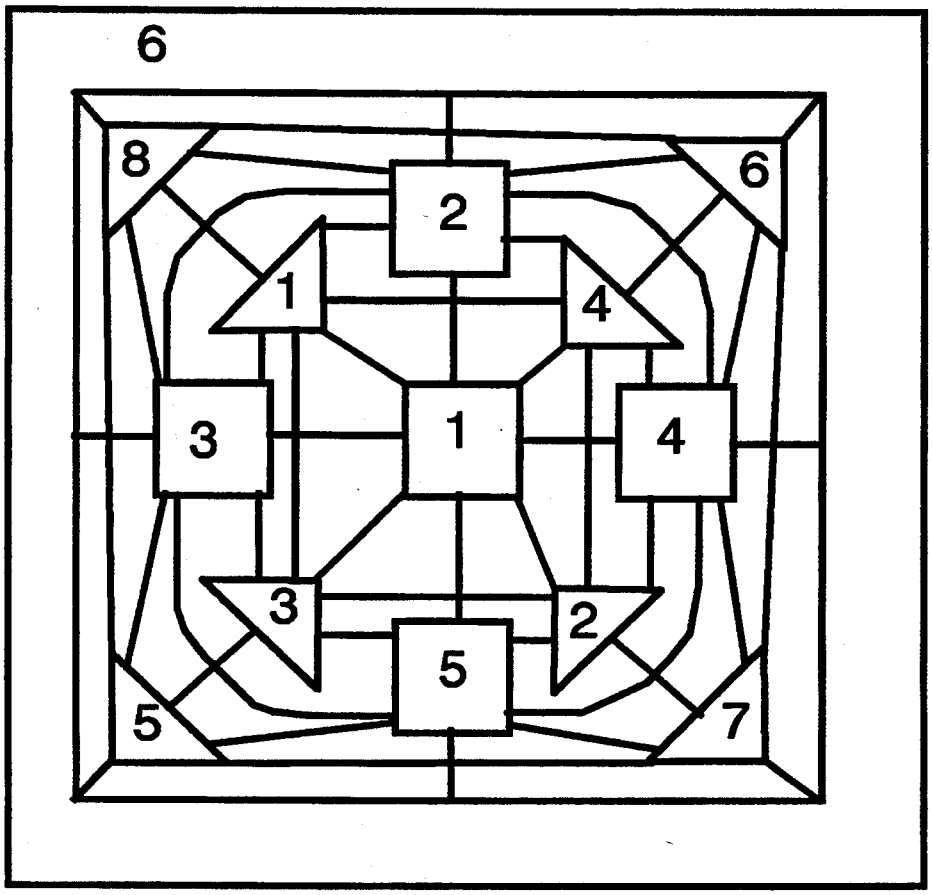
FIG. 13 shows a design for a board which is an embodiment of this invention containing two qualifying sets with specifiable bridge adjacencies, each qualifying set containing areas with numerical indicia. One of the qualifying sets in this design is the set of triangles with numerical indicia, which corresponds to the faces of an eight sided polyhedron or die. The other qualifying set in this design is the set of areas which contain numerical indicia and are not triangular. This second qualifying set of areas corresponds to the faces of a six sided polyhedron or die.
Figure 14:
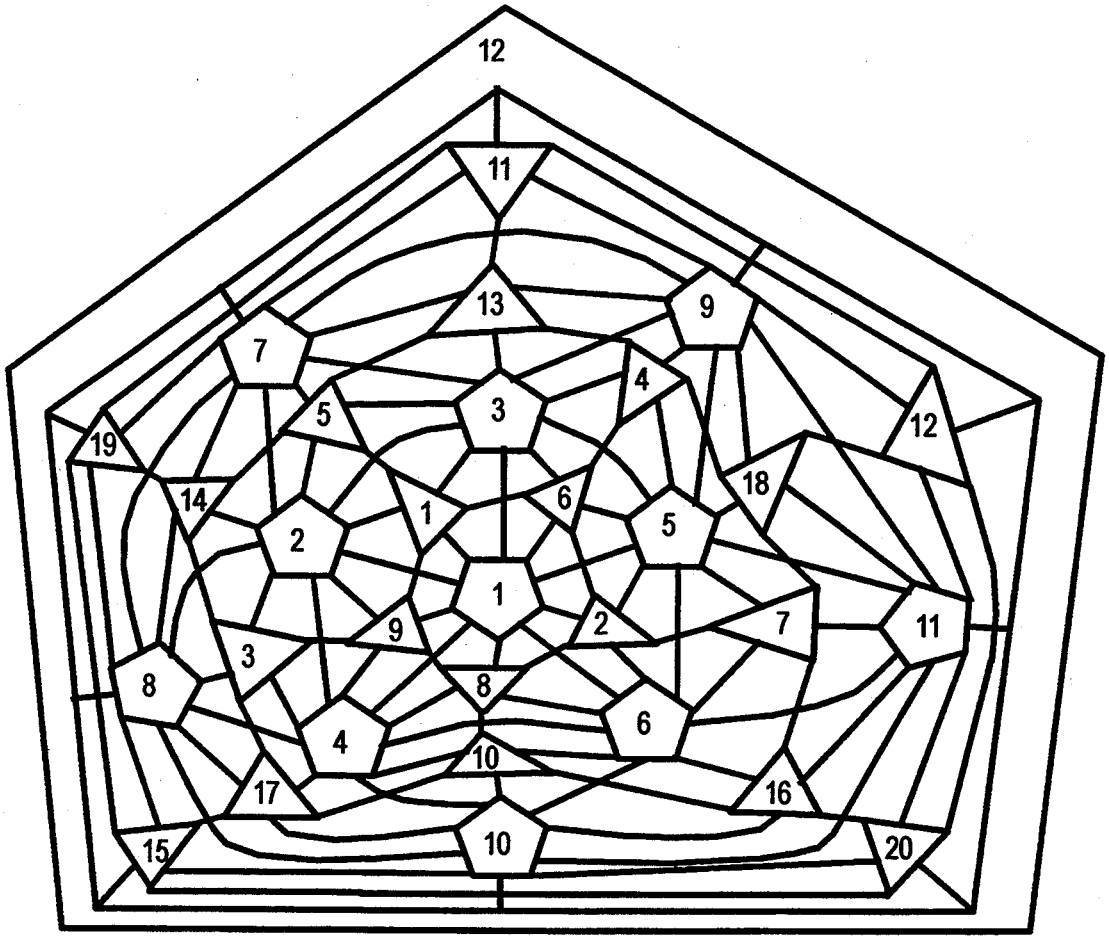
FIG. 14 shows a design for a board which is an embodiment of this invention containing two qualifying sets with specifiable bridge adjacencies, each qualifying set containing areas with numerical indicia. One of the qualifying sets in this design is the set of triangles with numerical indicia, which corresponds to the faces of a twenty sided polyhedron or die. The other qualifying set in this design is the set of areas which contain numerical indicia and are not triangular. This second qualifying set of areas corresponds to the faces of a twelve sided polyhedron or die.

The first preferred embodiment is a game which can be played on any board embodying this invention but for purposes of example we will use FIG. 12, FIG. 13, and FIG. 14, as possible boards.

In the first preferred embodiment a board having a qualifying set as previously described is chosen, and one or more random devices are used to determine placement of the pieces, and one or more random devices (possibly the same random device or devices) are used to determine the movement of pieces. FIG. 13 and FIG. 14 each contain sets of areas which correspond to the number of faces on a regular geometric solid, so dice (six-sided and/or eight-sided for FIG. 13; twelve-sided and/or twenty-sided for FIG. 15) could be used in these cases. In other cases a spinner could be used and/or only some of the areas could be used for placement and/or indicia may be repeated on some or all of the areas. If the areas used for placement are in a circular formation, as are the areas containing numerical indicia in FIG. 12, a spinner can be placed in the center of the board such that placement is decided based on where the spinner points, and areas may all lack indicia. In such a case (i.e. areas lacking indicia), the random device used to determine movement must still have indicia on it. In FIG. 12, since there are indicia on the areas in circular formation, a spinner can be placed in the center of the board and used for both placement and movement of pieces.

The object of the third embodiment is to dominate a single set or group of areas by having at least one piece on every area of the set, or to dominate a single area (possibly determined before play) by having a given number of pieces on the area.

Rules for the first preferred embodiment: The areas which will be used for placement are labeled with indicia which match the indicia on the random device or devices used for placement. In the case of a single random device (e.g. a spinner or a die) used for placement, the indicia indicated by the random device indicates an area (or group of areas having the same indicia) on which one or more (depending on the rules of the particular version of this embodiment) pieces can be placed. In the case of a single random device used for movement, the indicia indicated may indicate a choice of possible areas with similar indicia to which a piece already on the board may move.

When two or more random devices are used (in either situation) there is a choice of possible rules (naturally, all rules must be decided at the beginning of the game):

Possible rule (1): One or more pieces may be used for each random device. (e.g. a twelve-sided die result allows the placement or movement of 2 pieces, while a twenty-sided die result allows the placement or movement of 1 piece).

Possible rule (2): Some form of operation is performed on the results of the random devices. Some possible examples for numbers are addition, subtraction, average, maximum, or minimum. If the indicia on the random devices and on the spaces are symbols, some possible examples are union, intersection, non-intersection (e.g. if one die results in a "circle" and a "bar", and the other die results in a "bar" and a "star", then the results of these operations would respectively be:

(1) a "circle", a "bar", and a "star".

(2) a "bar".

(3) a "circle" and a "star".

Please note that these symbols are given as an example only, and no restriction is made on the shape of indicia.)

The results of the operation are applied to one or more of a player's pieces.

Possible rule (3): The results may be used by one or more pieces as above, or split among a given number of pieces or sets of pieces, as in Backgammon (where a player throwing a six and a five can move one piece by eleven or two pieces respectively by six and five).

Possible rule (4): The player may only use a certain number of the results and apply them according to whichever of the previous rules was agreed upon. (e.g. a possible version of this rule would be that a player throws three dice, but then must choose which two will be applied, ignoring the other.)

Other optional rules (which must also be agreed upon by all players before the start of a game) are:

(1) All of pieces owned by a player must be placed before any of that players pieces can be moved.

(2) Each player is assigned a specific set of areas which that player must dominate.

(3) A player must decided before activating the random device (e.g. throwing the die or dice, or spinning the spinner) which piece or pieces will be moved.

(4) A player must decide before activating the random device which set of areas the piece or pieces will be placed in or moved within, from, or to.

(5) A player must decide before activating the random device whether the piece or pieces will be placed or moved.

(6) A player may decide to move an opponent's piece or pieces.

(7) A player may place one or more pieces on bridges instead of (or as well as) on areas.

(8) Pieces and bridges may be color and/or style coded as described earlier herein (This rule would be obviously be decided on at the manufacturing stage).

(9): The results of the random device may be used to determine which space pieces may be moved from.

An example of this embodiment would have the following set of rules:

1. It is a two player game.
2. Each player has ten pieces.
3. The board used is the one shown in FIG. 13.
4. The random devices are a six-sided die and an eight-sided die.
5. The six-sided die is used for placement in the square areas, and the eight-sided die is used for placement in the triangular areas.
6. Players cannot place or move pieces belonging to an opponent.
7. No color coding is used; a piece can move along any bridge.
8. When rolling the dice for movement, the throw of the dice determines which areas can be moved from. If a player has no pieces on an area indicated by a die, that die's throw is useless, but if a player has any number of pieces on an area indicated by a die, that player may move one or more of those pieces, each to one adjacent area.
9. When a piece is placed on or moved to an area containing an opponent's piece or pieces, the opponent's piece or pieces on that area are removed from the board and given back to the opponent.
10. A player must decide before throwing the dice whether the piece or pieces will be moved or placed. The player may also choose to place with one die and move with the other, but must say which is which (e.g. "six for place, eight for move")
11. A player wins by dominating all the triangles or all of the squares.

Another example of this embodiment would be a gambling version in which each piece has a simulated or actual monetary value (e.g. one monetary unit per piece), or each area has a monetary value (e.g. each area has an triangles are worth one monetary unit and squares are worth two), or a monetary value is assigned to each possible configuration of pieces (e.g. having two pieces on one area might be assigned one monetary unit, having three pieces on one area might be assigned two monetary units, etc.), or any combination of these.

A specific example of this gambling version is the game previously described with the following additions:

12. At the first play, each player contributes 15 monetary units to the "pot".
13. A players winnings are determined by the number of pieces that player has on each area, as follows:

| each area with | of that player's pieces on it is worth |
|---|---|
| 1 | 1 monetary unit |
| 2 | 2 monetary units |
| 3 | 4 monetary units |
| 4 | 8 monetary units |
| 5 | 16 monetary units |
| 6 | 32 monetary units |
| 7 | 64 monetary units |
| 8 | 128 monetary units |
| 9 | 256 monetary units |
| 10 | 512 monetary units |

14. At the end of every play each player may decide to collect winnings from the "pot" (ending the game; the other player gets the remainder of the "pot". If the quitting player has winnings greater than the pot, which is very unlikely, the other player must supply the difference) or continue. To choose to continue, the player contributes 3 monetary units to the "pot".
15. If the game continues to the end, the winner takes the "pot".

For gambling establishments and charity raising events, the rules could be altered as follows:

1. One or two players may play the house. If one player plays, the house takes the place of the second player. If two players play, the house does not play to place or move, but instead throws the dice at the end of any round in which either player has more than one piece on one or more areas for a "stopper". A "stopper" is a total of 7, 8, or, 9, and stops the game without giving players any winnings.
2. When a player in a two player game takes winnings, the house takes that player's place in play, playing according to house rules, and no longer throws for "stoppers".
3. When a player in a two player game has more than one piece off the board, that player must place with both dice; when a player in a two player game has one piece off the board, that player must place with one die, and move with the other. The player must state, before the dice are thrown, which die is for placing and which is for moving.
4. There is no "pot". Instead, players pay 5 monetary units (instead of 3) to the house to continue the game, and collect winnings from the house. A player that wins a game gets 50 monetary units upon winning (the amount a player gets for winning to be referred to hereinafter as the player's game value). This can be increased in the following manner:
   a. if a player's game value is 50 monetary units, and that player simultaneously has two pieces on each of the four outer triangles and two pieces on the innermost square, that player's game value increases to 100 monetary units.
   b. if a player's game value is 100 monetary units, and that player simultaneously has two pieces on each of the four inner triangles and two pieces on the outermost (surrounding) square, that player's game value increases to 200 monetary units.

c. if a player's game value is 200 monetary units, and that player wins the game by dominating squares, that player may choose to forfeit the 200 monetary units and continue the game in an attempt to win by dominating triangles at a new game value of 400 monetary units. In this case the 400 monetary units can only be won by dominating triangles; dominating squares will no longer win the game for that player.

d. if a player's game value is 200 monetary units, and that player wins the game by dominating triangles, that player may choose to forfeit the 200 monetary units and continue the game in an attempt win by dominating squares at a new game value of 400 monetary units. In this case the 400 monetary units can only be won by dominating squares; dominating triangles will no longer win the game for that player.

e. if a player's game value is 400 monetary units and that player simultaneously has all ten pieces on the same area, and that player does not choose to take winnings, that player's game value increases to 800 monetary units. (The player may still choose to take winnings at any point in the game, but winnings are always determined by the pieces on the board when winnings are taken; e.g. if a player having 5 pieces on each of two squares decides to take winnings while that player's game value is 800 monetary units, that player's winnings are 32 monetary units.)

f. under no circumstances will the game value exceed 800 monetary units.

g. in a one player game, the player may choose to place one of the first two pieces without a die, but must throw the die for the other. (Note that due to the uniform nature of the board, where the first piece is placed will have absolutely no effect on the outcome probability the game, even if the player was the first of two players in a two player game. In other board games where pieces are moved, such a placement could give the player slightly better odds; e.g. in Backgammon (even if the game were a one player game) the first player could definitely alter odds if allowed to place a piece of choice on an area of choice instead of a die throw.)

5. The house has fourteen pieces, and may only place. The house does not have the option of taking winnings, and may not place more than one of its pieces on any area.

6. The player, when moving, must move only one piece from the area indicated by the die, even if that player has more than one piece on the specified area.

7. If the house wins the game, the game ends, and the single player does not collect any winnings.

The second preferred embodiment of this invention is a two player game (one player controls "inner" pieces; the other controls "outer" pieces) played on the board shown in FIG. 15, or FIG. 16, color coded in the following manner:

(1) Each line connecting two pentagons is one color which for purposes of example we shall call "red".

(2) Each line connecting two triangles is a second color which for purposes of example we shall call "blue".

(3) Each line connecting a triangle to a pentagon is a third color which for purposes or example we shall call "green".

The pieces are as follows:

(1) Each player has the following color coded pieces:
A large "red", "green", and "blue" "Queen",
A medium sized "red", "green", and "blue" "King",
A large "red" "Bishop of Pentagons",
A large "blue" "Bishop of Triangles",
A large "green" "Rook",
and ten small "red" and "blue" "Pawns".

(2) All of the "inner" player's pieces are one shape (for purposes of example, "cylindrical"), and all of the "outer" player's pieces are a second shape (for purposes of example, "rectangular").

At the beginning of the game, on a board designed according to FIG. 16, the pieces are set up as follows:

The "inner" "Bishop of Pentagons" is placed on the area with the indicia "IBP".

The "inner " "Bishop of Triangles" is placed on the area with the indicia "IBT".

The "inner" "Rook" is placed on the area with the indicia "IR".

The "inner" "Queen" is placed on the area with the indicia "IQ".

The "inner" "King" is placed on the area with the indicia "IK".

One "inner" "Pawn" is placed on each area which contains the indicia "IP".

One "inner" "Pawn" is placed on each intersection of a bridge between two areas which each contain the indicia "IP" and a bridge from an area which does not have the indicia "IP" (four such intersections exist).

The "outer" "Bishop of Pentagons" is placed on the area with the indicia "OBP".

The "outer" "Bishop of Triangles" is placed on the area with the indicia "OBT".

The "outer" "Rook" is placed on the area with the indicia "OR".

The "outer" "Queen" is placed on the area with the indicia "OQ".

The "outer" "King" is placed on the area with the indicia "OK".

One "outer" "Pawn" is placed on each area which contains the indicia "OP".

One "outer" "Pawn" is placed on each intersection of a bridge between two areas which each contain the indicia "OP" and a bridge from an area which does not contain the indicia "OP" (four such intersections exist).

Figure 15:
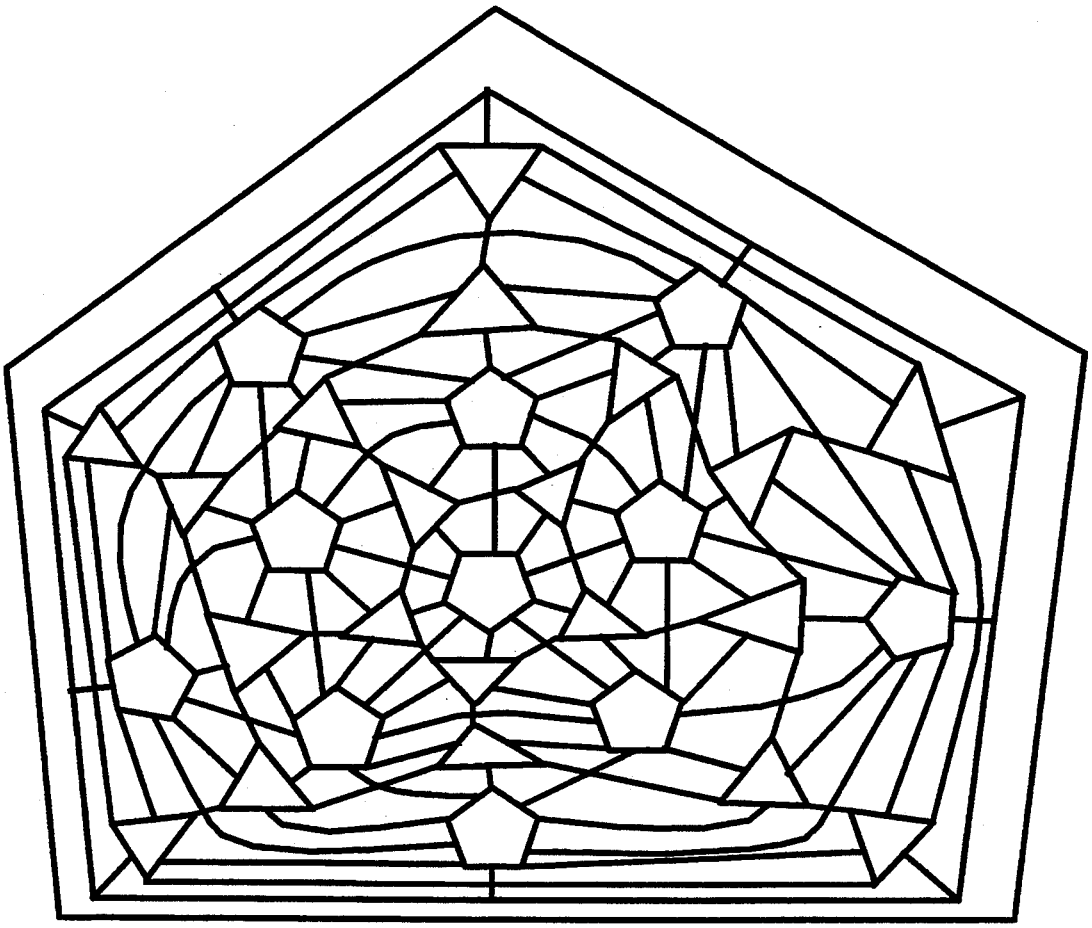
FIG. 15 shows a design for a board which is an embodiment of this invention, similar to the design shown in FIG. 16, but without indicia on any of its areas.
Figure 16:
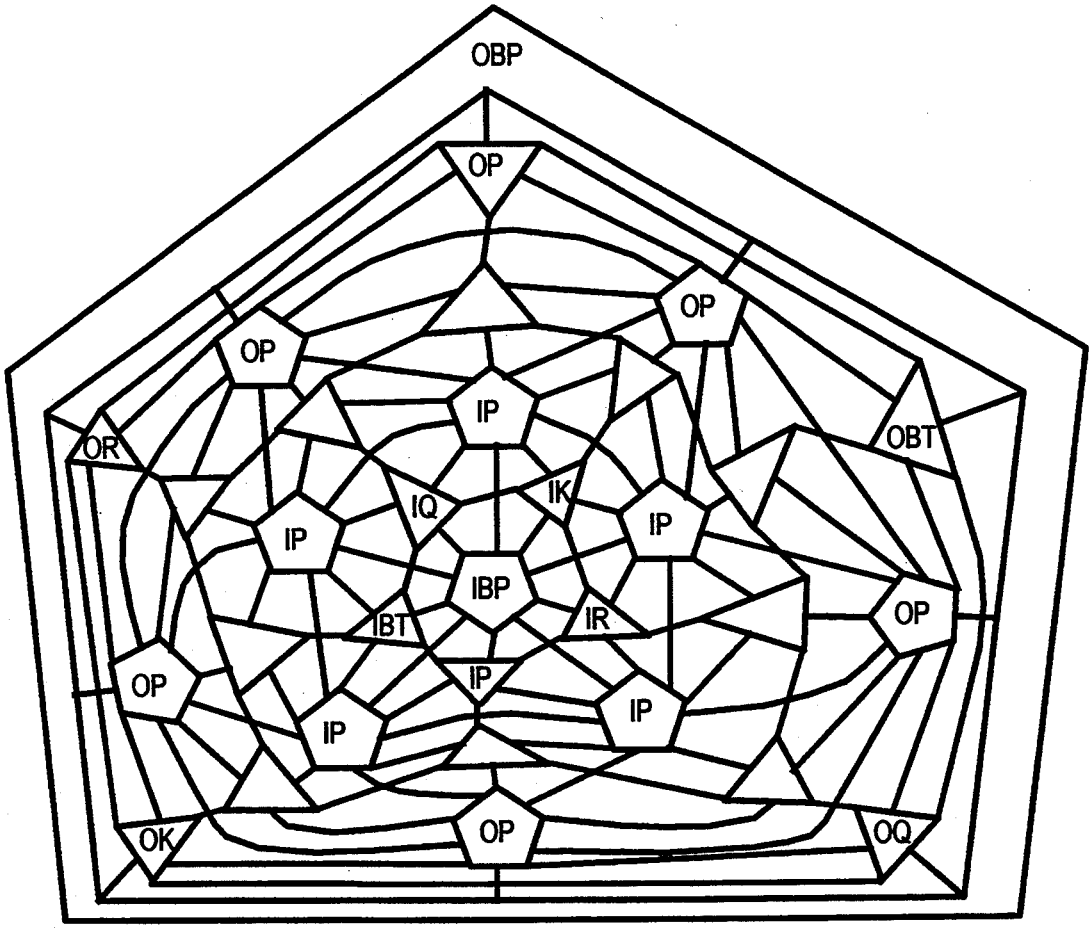
FIG. 16 shows a design for a board which is an embodiment of this invention, similar to the design shown in FIG. 17, but having lettered indicia on some areas to show the suggested starting placement of some pieces at the beginning of the game which is the fourth preferred embodiment of this invention.

(At the beginning of the game on a board designed according to FIG. 15, the pieces would be set up similarly; i.e. corresponding pieces would be placed on corresponding areas. NOTE: Although this is the suggested beginning piece position, there are 120 equivalent piece positions.)

The rules for moving and "taking" are as follows:

1. A piece "takes" (i.e. removes an opponent's piece from the board), as in a traditional chess game, by moving to an area occupied by an opponent's piece.

2. As in a traditional chess game, only one piece can occupy an area at any given time, and no player may make a move which puts that player's "King" in "check" (i.e. a move which makes the area where that player's "King" rests accessible to any opposing piece).

3. The player controlling the center pieces makes the first move, and players take turns moving one piece per move.
3. Any large piece makes a single move by following any path of bridges of a color contained by the piece to either an empty area or a area occupied by an opponent's piece. If move is made to an area occupied by an opponent's piece, the opponent's piece is taken.
4. The "King", the only medium sized piece, makes a single move by crossing a single bridge from one area to another. As in a traditional game of chess, the "King" cannot move into "check" (i.e. cannot move onto an area accessible to an opponent's piece).
5. The "Pawn", the only small piece, makes a single move by moving half the length of a "red" or "blue" bridge, either from an intersection to an area or from an area to an intersection.
6. A group of "Pawns" may "queen" an opposing "Pawn" by any of the following methods:
(1) If the opposing "Pawn" is on a pentagonal area, by occupying all of the adjacent pentagonal areas.
(2) If the opposing "Pawn" is on a triangular area, by occupying all of the adjacent pentagonal areas OR all of the adjacent triangular areas.
(3) If the opposing "Pawn" is on an intersection, by occupying the pentagonal areas which surround the "red" bridge of the intersection AND the triangular areas which surround the "blue" bridge of the intersection.

When a "Pawn" is "queened", the player having the surrounding "Pawns" removes the opposing "queened" "Pawn" and replaces it with any non-opposing large piece.

7. A "Pawn" cannot take a larger piece, but it can "check" an opposing "King" by moving to an intersection crossed by a bridge connected to the area occupied by the opposing "King".
8. When checking an opponent (i.e. attacking the opponents "King" by moving a non-opposing piece to an area from which it could "take" the opposing "King"), a player must say "check", and the opponent must, if possible, respond with a move which removes the "King" from check, either by moving the "King", taking the threatening piece, or interposing a third piece.

The object of the game is to "checkmate" the opposing "King" (i.e. to put it in a position of "check" such that no move by the opposing player will remove the opposing "King" from "check". The winning player, upon winning must say "checkmate".

"Draw" rules.

1. If the same position appears on the board three times, a player can claim a "draw" on the third time.
2. If neither player has any large pieces left and one player either has no "Pawns" on the board, or has only "Pawns" which are placed in a position in which they cannot be taken by the opposing "King" or "queened" by opposing "Pawns", that player can declare a "draw".
3. If a player has no large pieces left but has "Pawns", that player may declare a "draw" if five moves pass without any pieces being "taken" or "queened".
4. If a player has only a "King" (and no other pieces) and twenty moves pass without a "checkmate", that player may declare a "draw".
5. If both players have only a "King", then the game is a "draw".
6. If a player's "King" is not in "check", and it is that player's turn to move, but no move can be made that will not put that player's "King" in "check" the game is said to be a "stalemate" and is scored as a "draw".

It is obvious that other embodiments could be created by using another board meeting the previously defined requirements, e.g. for each additional set of areas, a new "Bishop" could be created, and additional types and levels of "Rooks" could be created (e.g. on a three-set board, a "Rook" which moves between two sets of areas (as in the preferred embodiment), and a "Rook" which moves between three sets of areas), and it is not necessary that a strategy game embodiment be limited to two players, nor is it necessary that the rules be so similar to traditional chess, e.g. the object of the game could be to remove all of an opponent's pieces, or to "queen" a "Pawn", or to move all of one's pieces to a specific portion of the board (in which case there could be defined rules for retrieval of pieces taken from the board), or each player could have a different object, or the game could be a solitare game with, for example the object of removing all pieces but one from the board.

Note that the uniformity of the board in this embodiment makes it so that, unlike in traditional chess, no areas of any type are to any degree preferable to any other areas of the board by virtue of their position. In traditional chess, the center squares are more powerful because there are more places to which a piece can move or take from a center square than from a side or corner square. This is not true in the game presented (although a pentagonal area might be considered more powerful than a triangular area in the game presented, as a pentagonal area has ten adjacencies while a triangular area has only six. On the other hand, a triangular area might be considered more powerful because the average path of legal moves from a triangular area is much longer than the average path of legal moves from a pentagonal area).

The foregoing was given for illustrative purposes and no unnecessary limitations in the claims should be drawn therefrom.

I claim:

1. A game board having on its surface one or more pluralities of areas, at least one plurality of areas within said one or more pluralities of areas comprising at least six areas and comprising a plurality of adjacencies between said at least six areas wherein:

(a) a plurality of adjacencies exists wherein each area of said at least one plurality of areas is adjacent via at least one adjacency within said plurality of adjacencies to each of at least three other areas within the same said at least one plurality of areas, wherein said plurality of adjacencies comprises bridges, borders, or any combination of the two, and
(b) said at least three other areas are equal in number for any two areas within said at least one plurality of areas, and
(c) any adjacency not within said plurality of adjacencies between any two areas within said at least one plurality of areas is different in appearance from any adjacency within said plurality of adjacencies, and,
(d) there is at least one path of adjacencies between any two areas within said at least one plurality of areas, wherein each adjacency within said at least one path of adjacencies is an adjacency within said plurality of adjacencies, and (e) said at least one plurality of areas is not drawn as a mapping of a polyhedron wherein:

each face of said polyhedron is represented by an area which is not within said at least one plurality of areas, each of all but one of the vertices of said polyhedron is represented by a point, the remaining vertex of said polyhedron is represented by a circle which is made up of the outermost borders of areas within said at least one plurality of areas, and each said area which is not within said at least one plurality of areas is connected by a line to each of the points representing its corners, and no said line crosses any other said line, and (f) said one or more pluralities of areas does not solely consist of one or more concentric pluralities of areas wherein:

said at least three areas number three, each of said one or more concentric pluralities of areas is divisible into two concentric pluralities of areas wherein all areas within each of said two concentric pluralities are equal in size, and (g) said at least one plurality of areas is not both the sole plurality of areas fulfilling all other requirements listed herein, and a plurality of areas wherein:

said at least areas number six, and said at least one plurality of areas is geometrically rotationally symmetrical.

2. A game of chance for one or more players utilizing the game board of claim 1 and further consisting of one or more sets of pieces, one or more random devices, and a set of rules by which pieces may be placed, moved and removed from the board.

3. A game of strategy for two players utilizing the game board of claim 2, further comprising a plurality of pieces for each player, and a set of rules by which the game is played.

4. The game of claim 3 utilizing a color coding scheme which matches the colors of the pieces with the colors of the paths they may take in play.

5. The game of claim 4 utilizing a style coding scheme which assigns a given type of move to each style of line on the board.

6. The game of claim 3 utilizing a style coding scheme which assigns a given type of move to each style of line on the board.

7. The game of claim 2 utilizing a color coding scheme which matches the colors of the pieces with the colors of the paths they may take in play.

8. The game of claim 7 utilizing a style coding scheme which assigns a given type of line on the board.

9. The game of claim 2 utilizing a style coding scheme which assigns a given type of line on the board.

* * * * *